US005406674A

United States Patent [19]

Lawter et al.

[11] Patent Number: 5,406,674

[45] Date of Patent: Apr. 18, 1995

[54] RESILIENTLY CUSHIONED ACTIVATING MEANS FOR POWER ASSIST

[75] Inventors: Raymond L. Lawter, Millersburg; Douglass A. King, North Canton; Rodney J. Svik, Canton, all of Ohio

[73] Assignee: The Hoover Company, North Canton, Ohio

[21] Appl. No.: 34,413

[22] Filed: Mar. 19, 1993

[51] Int. Cl.[6] ..... A47L 7/00

[52] U.S. Cl. ..... 15/340.2; 15/410; 180/19.3

[58] Field of Search ..... 15/340.2, 410; 180/19.1-19.3; 192/48.9, 48.91

[56] References Cited

U.S. PATENT DOCUMENTS

| | | | |
|---|---|---|---|
| 1,791,812 | 2/1931 | Harrison . | |
| 3,218,876 | 11/1965 | Berger | 15/340.2 |
| 3,220,043 | 11/1965 | Lampe | 180/19.3 |
| 3,225,853 | 12/1965 | Norton et al. | 180/19 |
| 3,557,893 | 1/1971 | Kohls | 180/19 |
| 3,618,687 | 11/1971 | Ripple et al. | 180/19 H |
| 3,854,164 | 12/1974 | Schmitz et al. | 15/340 |
| 3,896,892 | 7/1975 | Kohls et al. | 180/19 H |
| 3,938,216 | 2/1976 | Schmitz et al. | 15/340.2 |
| 3,941,198 | 3/1976 | Kappas | 180/19.3 |
| 4,155,143 | 5/1979 | Garbe | 15/410 |
| 4,212,363 | 7/1980 | Letner et al. | 180/19.3 |
| 4,249,281 | 2/1981 | Meyer et al. | 15/340 |
| 4,342,369 | 8/1982 | Ransom | 15/340.2 |
| 4,347,643 | 9/1982 | Bair | 15/340 |
| 4,624,027 | 11/1986 | Martin | 15/340.2 |
| 4,667,459 | 5/1987 | Scanland et al. | 180/19.3 |
| 4,845,803 | 7/1989 | King | 15/339 |

*Primary Examiner*—David A. Scherbel
*Assistant Examiner*—Patrick F. Brinson

[57] ABSTRACT

A power assisted upright cleaner is provided with resilient spring cushioning for a hand grip driven actuating means that initiates power assist for the cleaner.

15 Claims, 13 Drawing Sheets

"PRIOR ART"

"PRIOR ART"

RESILIENTLY CUSHIONED ACTIVATING MEANS FOR POWER ASSIST

BACKGROUND OF THE INVENTION

1. Field of the Invention

This invention relates to power assisted upright vacuum cleaners or the like and, more specifically, to a resiliently cushioned actuating means for such a cleaner that initiates the cleaner's power assist.

2. Summary of the Prior Art

Handle or hand grip actuation of a power assisted vacuum cleaner or the like are old and well known where reciprocation of the handle or hand grip relative to the power assisted appliance initiates or terminates power assist. Some of these units even include some sort of spring dampening which, in some manner, is attached to the handle or even the hand grip. But these arrangements, heretofore, have placed the resilient member or spring in a parallel disposition relative to the actual actuating drive line. How much better would be an in-line or series disposition of the spring so that any inertia or low ineffective spring force would be taken up before movement of the power assist drive line. This would insure full cushioning for the total initiating movement of the power assist drive line rather than only for a portion of its travel. A direct drive is thereby provided by the resilient spring element rather than an indirect one.

Accordingly, it is an object of the invention to provide a cleaner or the like having power assist with an in-line resilient element in the power assist actuating means.

It is an additional object of the invention to utilize a variety of differing resilient spring elements to accomplish this purpose.

It is a still further object of the invention to provide at least one improved hand grip structure to accommodate one of the resilient spring elements.

It is an even further object of the invention to provide an improved drive line actuating means for a power assisted cleaner or the like.

SUMMARY OF THE INVENTION

A power assisted push unit such as a vacuum cleaner is the locus of our invention. Such a vacuum cleaner may exemplarily include a wheeled nozzle body surmounted by, e.g., a cleaner bag receiving housing pivoted, as is conventional, to the nozzle body. Mounted within the nozzle is a conventional gear drive which urgingly drives the nozzle body forwardly and rearwardly, dependent on forward or rearward movement of a hand grip, mounted on a handle extending upwardly from the bag receiving housing. Attached to it is a Bowden wire cable extending downwardly through it and the handle to move the clutching arrangement of the gear drive leftwardly or rightwardly to provide the forward or reverse drive.

The invention modification to this exemplary structure is the use of a spring dampening means in the actuating linkage line consisting of the hand grip, Bowden wire or the like and its lower attachment to the clutch actuator. Specifically, this is accomplished by the use of a compression spring consisting, of a compression block or a torsion spring or a pair of torsion springs, all situated in a series or in-line relationship in the foregoing actuating linkage.

Preferably this spring dampening means is located in the hand grip and positioned interposed between it and the Bowden wire cable so its ends act directly against the hand grip and the Bowden wire cable. This insures that the action of the spring's resilient cushioning or dampening occurs prior to initiation of the clutch linkage. In other words, the spring's minimal inertia must be accommodated prior to movement of the total linkage so that there is actual, active spring dampening, immediately, upon movement of the total actuating linkage.

A specific pair of hand grip-handle arrangements are also disclosed which utilizes, effectively, a resilient compression block or a torsion spring, with these hand grip arrangements being practically designed to provide effective dampening in a hand grip of limited length and girth.

BRIEF DESCRIPTION OF THE DRAWINGS

Reference may now be had to the accompanying Drawings for a better understanding of the invention, both as to its organization and function, with the illustration showing a preferred embodiment and several alternatives, but being only exemplary, and in which:

FIG. 1A is an enlarged view of that portion of FIG. 1 at the clutch driving linkage;

DETAILED DESCRIPTION OF THE INVENTION

Figure 1:
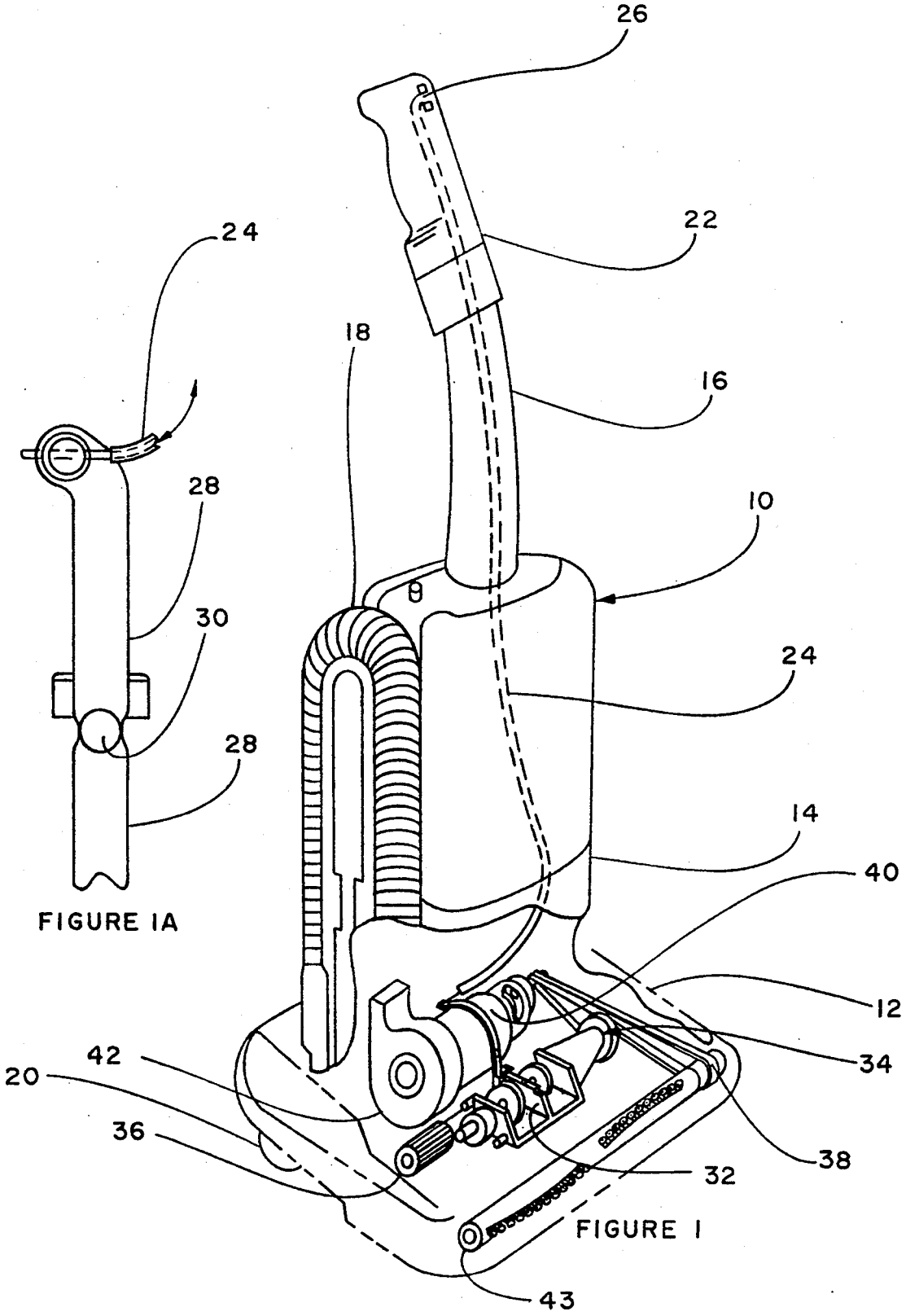
FIG. 1 is a perspective view of an exemplary cleaner having power assist and assist initiating means and to which our invention might be applied.

There is shown in FIG. 1 a power assisted vacuum cleaner 10 having a main suction body 12 and an upwardly extending bag encompassing housing 14 surmounted by a handle 16. A conversion hose 18 may be side mounted to the housing 14. Rear wheels 20, 20 (only one shown) provide free rolling for the rear of the power assisted cleaner 10.

As is usual in such a cleaner, a reciprocating hand grip 22 mounted on the upper end of the handle 16 drives an internal extended link 24, normally taking the form of a Bowden wire cable, disposed within both the hand grip 22 and handle 16. The link 24 is connected to the hand grip 22 by a connection 26 (shown schematically) to receive a positive drive from it. At its bottom the extended link 24 is attached to a clutch actuating lever 28 pivoted at pin 30 on the suction body 12 with this lever moving a clutch clevis member 32 rightwardly or leftwardly to engage forward or rearward clutching of a power assist transmission 34. Drive wheels 36, 36 (only one shown) are motivated by this transmission.

The power assist arrangement just described from the extended link or Bowden wire cable 24 downwardly through the drive wheels 36, 36 is more specifically disclosed in U.S. Pat. No. 3,618,687, owned by a common assignee. It is hereby made of reference.

The transmission 34 receives, as is as usual, its drive through a driving belt 38 actuated by a motor 40. The motor 40 also drives a fan 42 to provide suction to the suction body 12 and an agitator 43.

Figure 2:
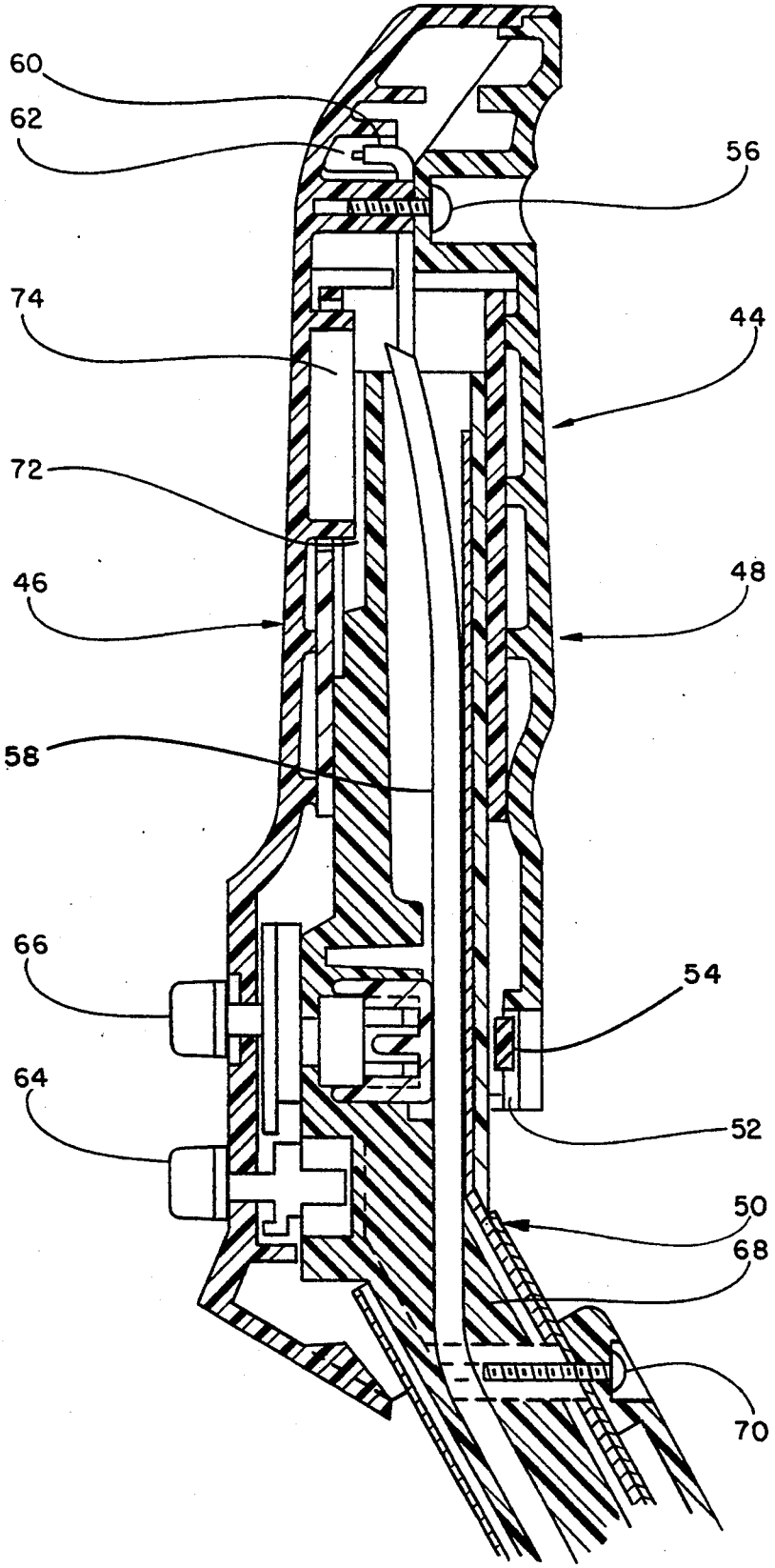
FIG. 2 is a cross-sectional elevational view of the present production Hoover® power assist cleaner handle and hand grip and, thus, represents prior art.
Figure 3:
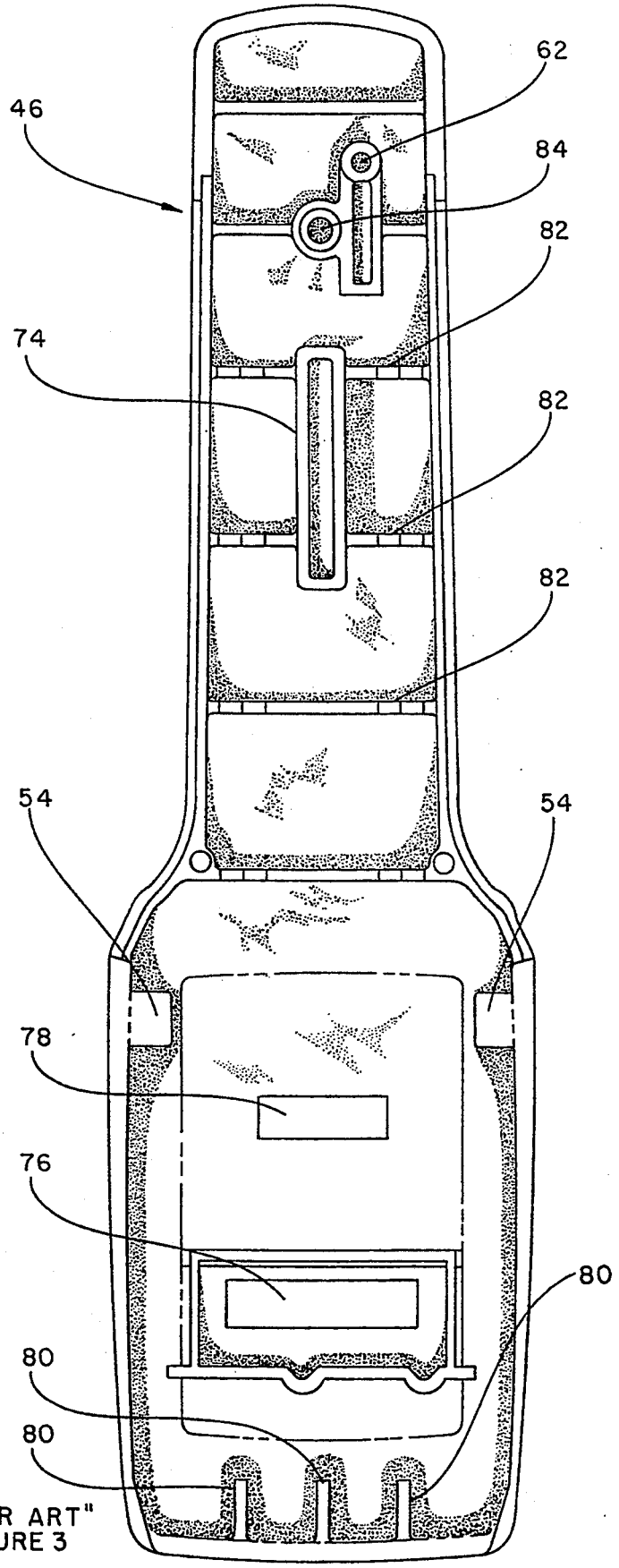
FIG. 3 is a plan view of the inside of the upper handle housing of this power assist hand grip configuration, and, thus also represents prior art.
Figure 4:
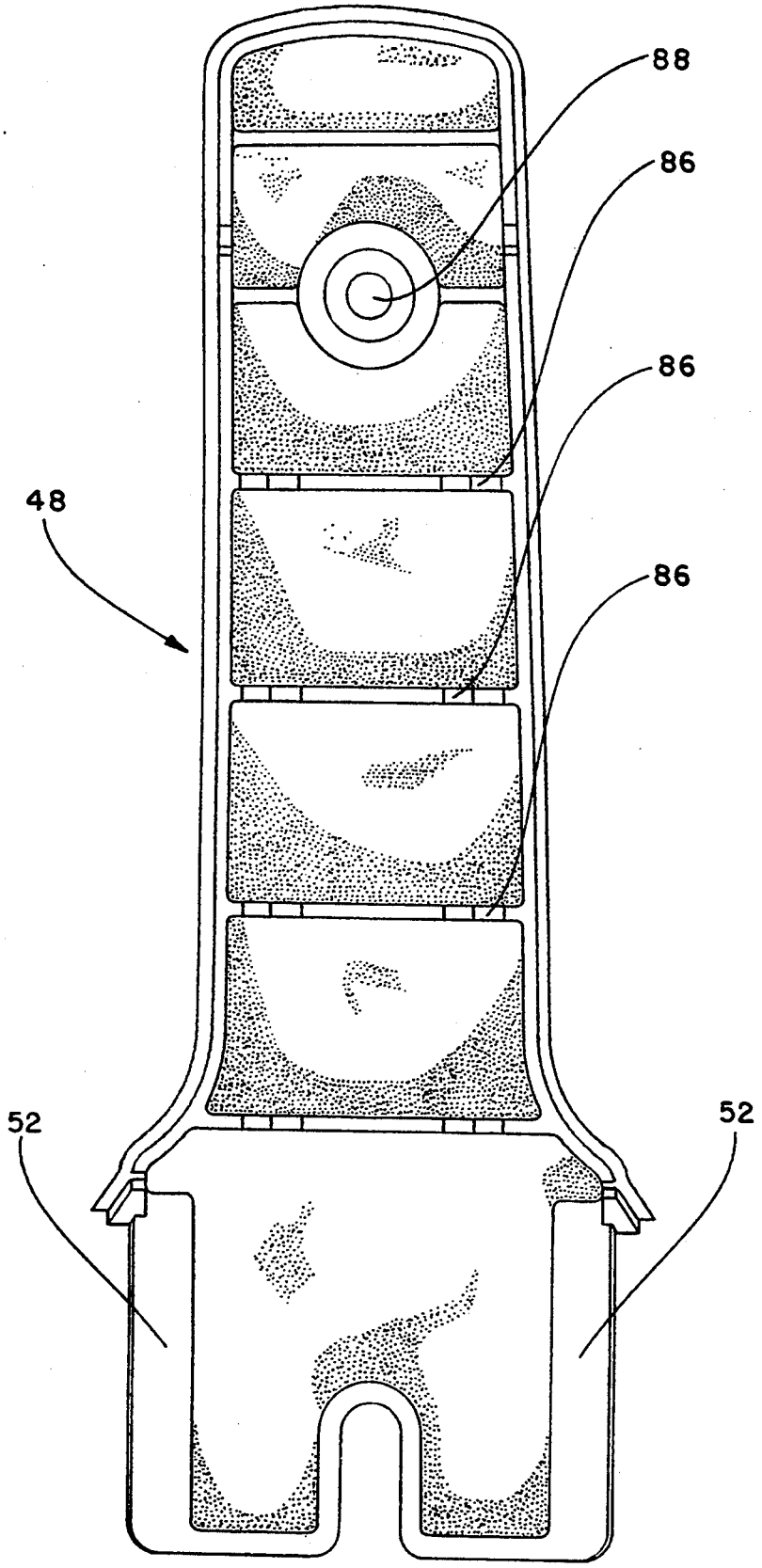
PRIOR ART FIGURE 4
FIG. 4 is a plan view of the lower half of the same hand grip.

In FIGS. 2–4 are shown, as prior art, a presently commercially used power assist reciprocating hand grip 44. This hand grip is also shown and described in U.S. Pat. No. 4,845,803, hereby made of reference herein, and owned by a common assignee.

Hand grip 44 includes upper and lower housing parts 46, 48, respectively, which mate together to form the outer shell of hand grip 44. The hand grip 44 telescopically mounts over a cleaner handle 50 by the sliding of tabs 52, 52 on the lower housing part 48 (FIG. 4) under a pair of tabs 54, 54 integral with the upper housing part 46 (FIG. 3). A screw 56 connects the two housing parts 46, 48 together at their upper rearward extent.

An extended link in the form of a Bowden wire cable 58 is attached to hand grip 44 by a hooked end 60 that extends into a blind bore 62 in upper housing part 46. The Bowden wire cable 58, as is conventional, also extends downwardly in handle 50 to be attached, e.g., to the power assist transmission 34 of FIG. 1. Thus, the actuating linkage for the transmission 34 in this prior art device includes no resilient cushioning.

An operator contactable button 64 reciprocates to insure neutralling of the hand grip 44 while an operator contactable button 66 provides an on-off switching function. It is mounted on this same hand grip 44.

Conveniently, a hand grip support 68 is disposed between the hand grip 44 and the handle 50 to mount the two together. This hand grip support 68 extends upwardly from a telescopic engagement in handle 50 to extend through a major portion of hand grip 44. At its bottom, a screw 70 attaches the hand grip support 68 to the handle 50, while a slot 72 in hand grip support 68 mates with a hollow, elongated, rectangular boss 74 integral with upper housing part 46, at its rear, to permit limited sliding reciprocation of the hand grip 44 relative to the handle 50.

Slots 76, 78 in upper housing part 46 (FIG. 3) permit sliding of the buttons 64,.66, respectively, to establishing neutralling and to actuate electrical switching. Front axially extending strengthening ribs 80, 80, 80 and rearwardly disposed arcuate ribs 82, e.g., aid in providing a durable substantially rigid structure for upper housing part 46. A blind bore 84 adjacent Bowden wire cable bore 62 provides mounting for the connecting screw 56.

Lower housing part 48 (FIG. 4) also includes arcuate ribs, such as rib 86 and a through bore 88 for passage of the connecting screw 56.

Figures 5, 5A:
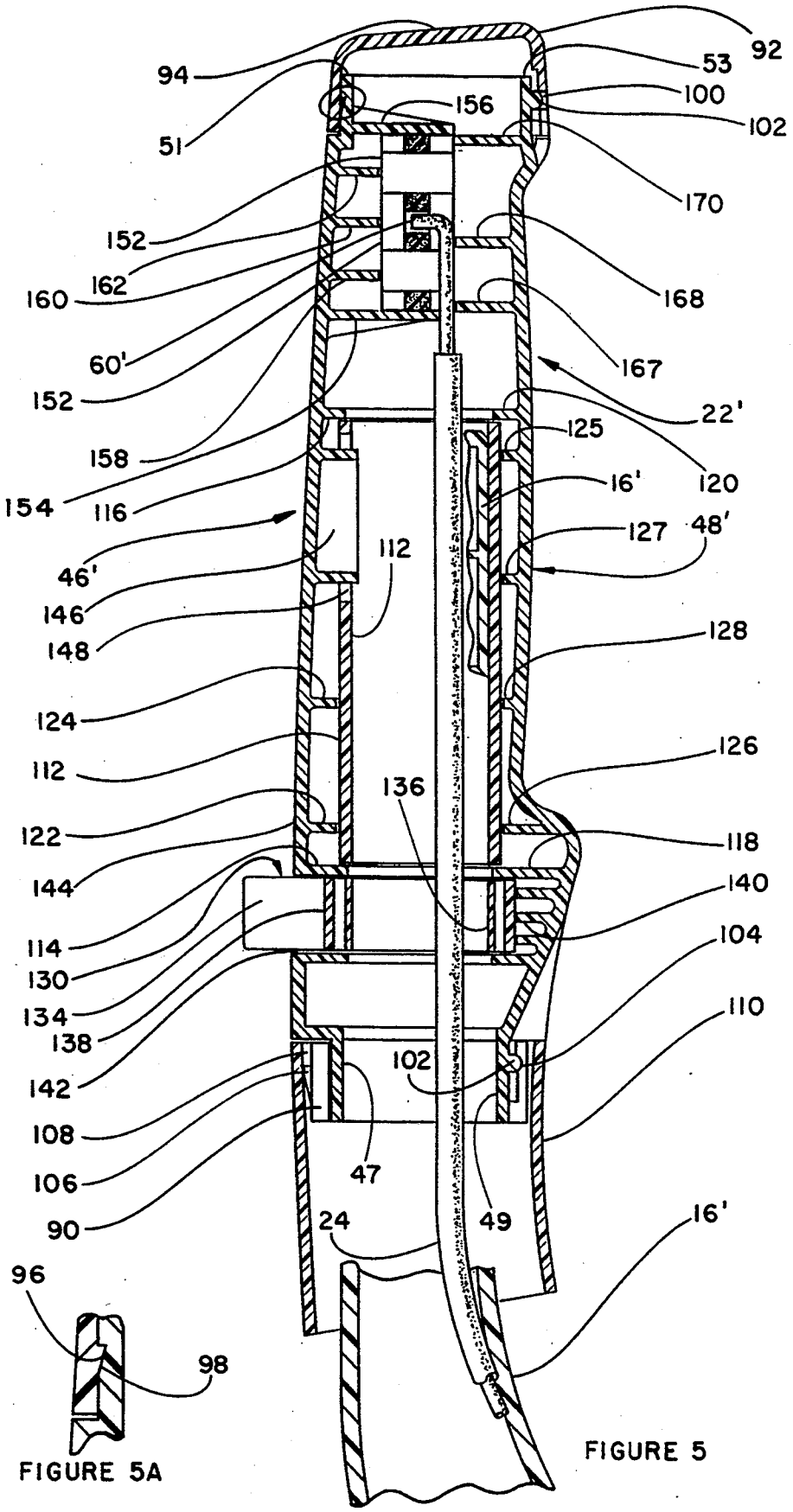
FIG. 5 is a cross-sectional elevational view of a modified hand grip designed to act with a compression block in the actuating linkage.
FIG. 5A is an enlarged portion of FIG. 5 shown circled.
Figure 6:
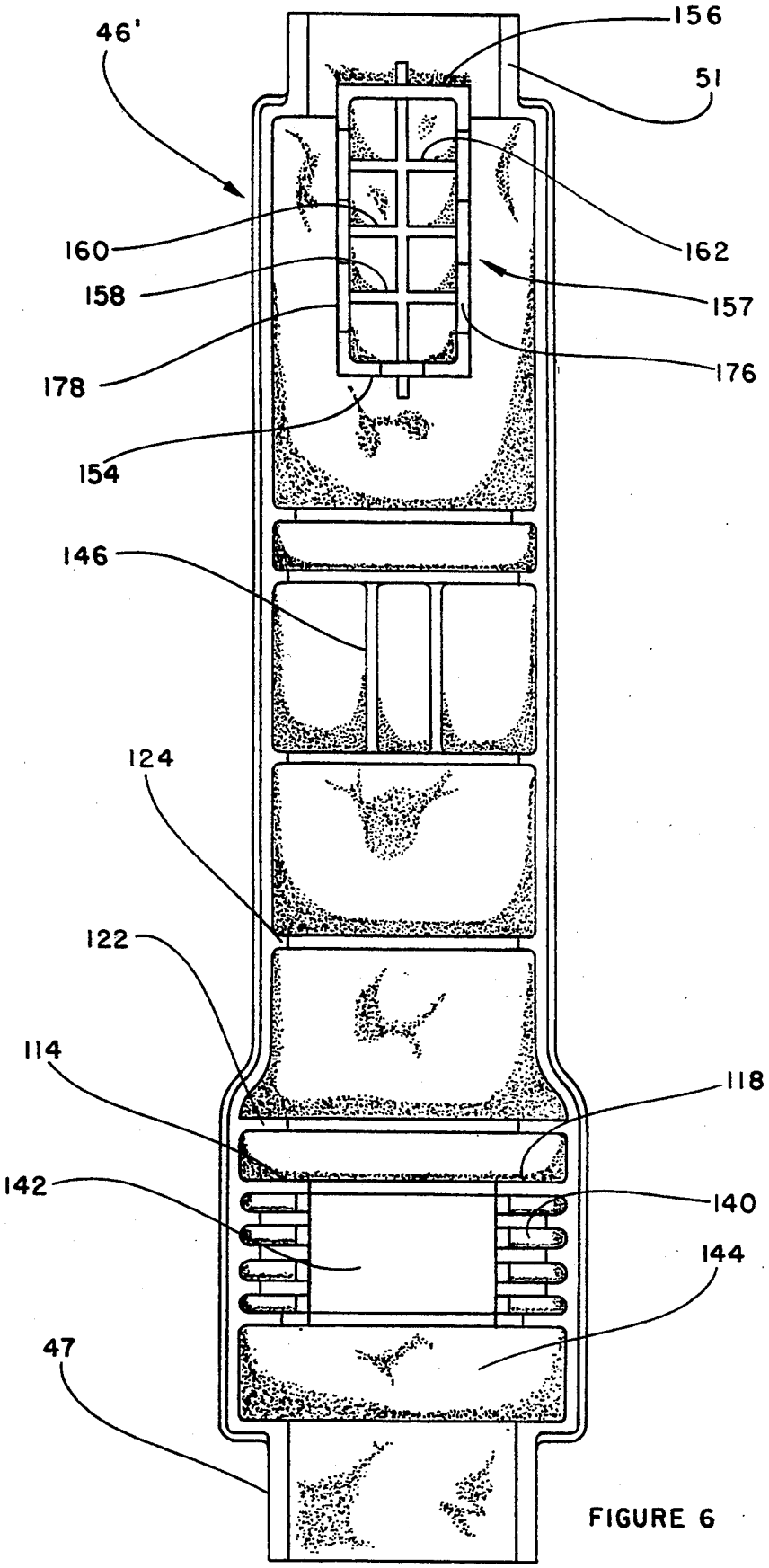
FIG. 6 is a plan view of the inside of the upper half of this hand grip.
Figure 7:
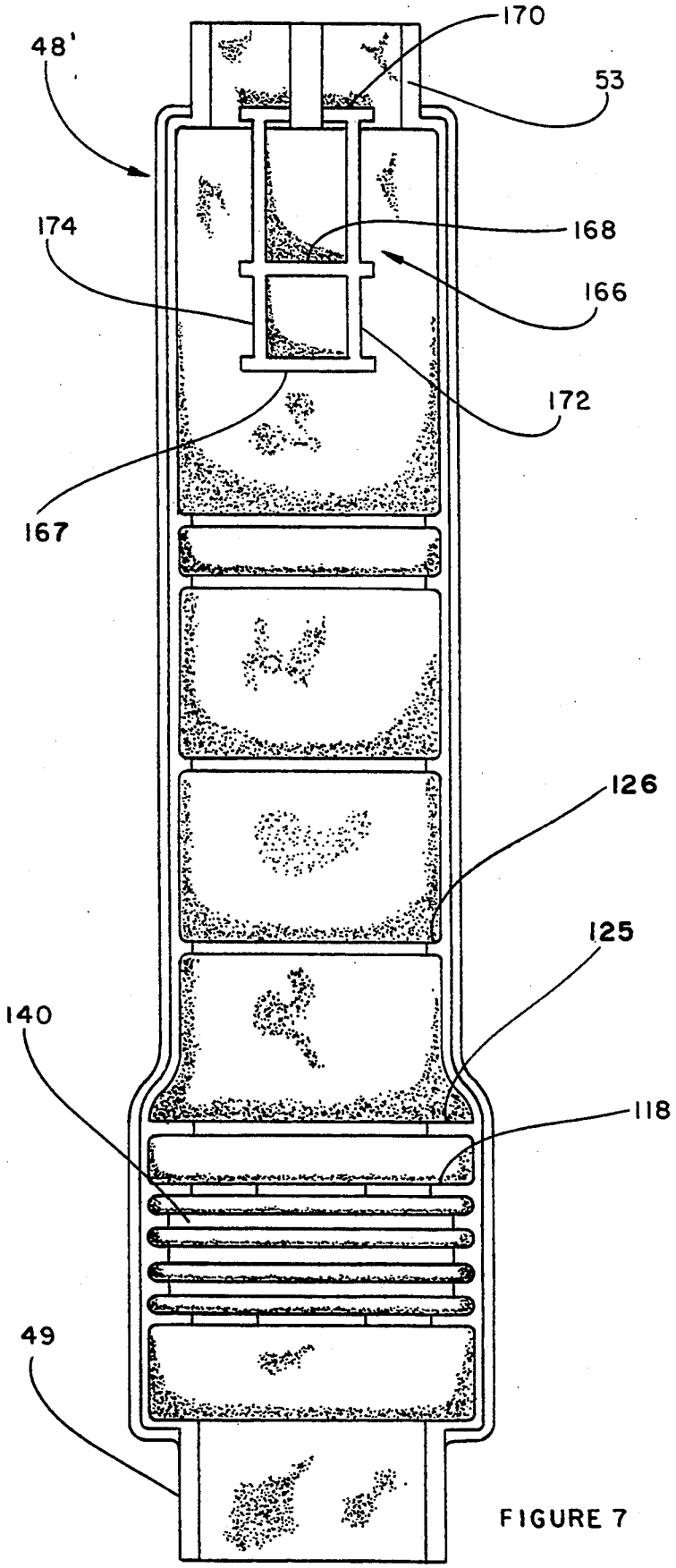
FIG. 7 is a plan view of the lower half of this hand grip.

Turning to the first embodiment of the invention shown in FIG. 5–15 and with specific attention to FIGS. 5–7 and wherein like numbers denote like elements as in FIG. 1 or FIGS. 2–4 and primed numbers indicate modified elements, a handle 16′ mounts a hand grip 22′ through both of which extend an elongated link, Bowden wire cable 24.

The hand grip 22′ is formed from a pair of opposed upper and lower housing parts 46′, 48′, respectively that are held together at their front ends 47, 49 by a split compression clamp ring 90 (split not shown) compressingly telescoped thereover and an end cap member 92 also compressingly mounted over the rear ends 51, 53 of the upper and-lower housing parts 46′, 48′. The end cap includes a rear outside wall 94 which closes the rearward end of the hand grip 22′. It also includes at least one locking barb 96 at its upper side engageable in a similarly shape depression 98 in upper housing part 46′. It also includes a small locking through bore 100 into which is received a locking teat 102 on lower housing part 48′. The clamp ring 90 similarly also at least includes a semi-circular locking depression 104 into which is received a second locking teat 102 integral with lower housing portion 48′.

To aid in mounting split clamp ring 90 within handle 16′ and thereby insure its stable telescopic engagement with hand grip 22′, a series of three angle ramps 106, 106, 106 (only one shown) are provided extending outwardly from and disposed evenly around its periphery. These angled ramps, upon insertion of the clamp ring 90 (already mounted on the hand grip 22′) ride cammingly over a series of three lands 108 (only one shown) mounted integrally with a handle shield 110 to positively lock the hand grip 22 to the handle shield 110 through the expanding force of split compression ring 90.

A bearing sleeve 112 of hollow configuration is disposed within the hand grip 22′ to provide ease in sliding reciprocation of the hand grip 22′ relative to the handle 16′. This bearing sleeve is limited in movement axially by inwardly extending ribs 114, 116 on upper housing part 46′ and by inwardly extending ribs 118, 120 on lower housing portion 48′. Ribs such as ribs 122,124, 125, 126, 127 and 128 limit radial movement of this same sleeve.

Figure 8:
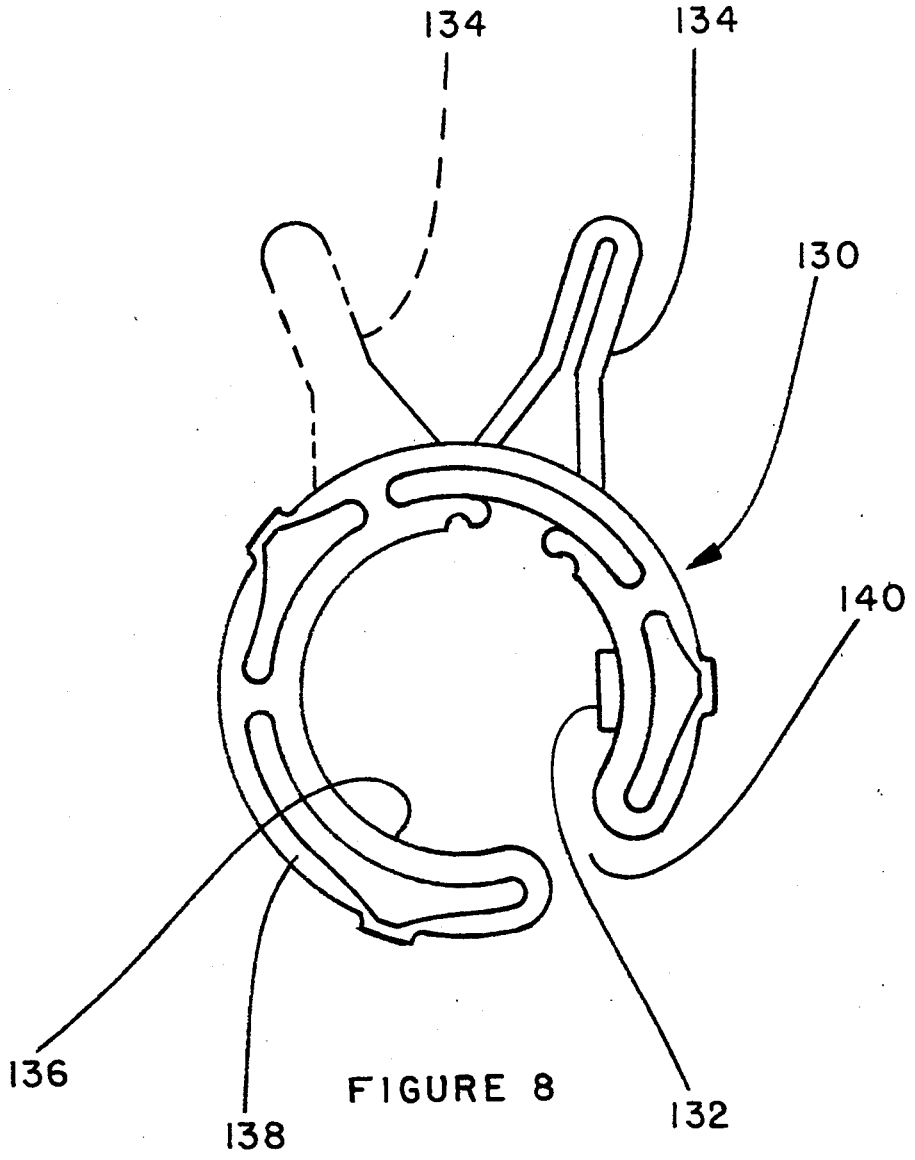
FIG. 8 is a plan elevation view of the locking ring utilized with this hand grip.

A ring member 130 is disposed in forward portions of hand grip 22 to provide neutralling for the power drive cleaner 10. It includes, for neutralling, an inwardly extending button 132 (FIG. 8) which in neutralling position engages with the handle 16' in a well known manner by inserting movement into an aperture (not seen) in the handle 16' proper. FIG. 8 shows in dashed position a finger piece 134 for the button 132 in active power drive position while the full line portion in this Figure illustrates the position of the finger piece 134 with the button 132 in neutralling position.

The ring member 130 includes inner and outer rims 136, 138 having a discontinuity 140 at the bottom of the ring member 130 for its easy spring mounting over the handle 16'. The inner rim 136 of the ring member 130 compressingly engages the handle 16' so as to be maintained thereon for rotational movement by the finger piece 134 while the outer rim 138 rotates on a seat 140 formed by ribs in the lower housing parts 48'. An aperture 142 extends through an outer top wall portion 144 of upper housing part 46' to permit finger piece 134 to extend therethrough for easy operator manipulation.

Hand grip 22' is guided in its reciprocating movement on handle 16' by an upper box form 146 formed in rearward portion of upper housing part 46' which fits downwardly into an axially extending slot 148 formed in bearing sleeve 112. By this arrangement, then, the hand grip 22' moves Bowden wire cable 24 to initiate action of the power drive of the cleaner.

Turning now to the more inventive aspects of this Application, it can be seen the Bowden wire cable 24 is mounted by a hook 60' into a compression block 152 of resiliently compressible material such as urethane, vinyl, rubber or various other elastomers. This block is disposed to act between the hand grip 22' and the Bowden wire by being mounted fixedly between two depending end ribs 154, 156 axially spaced apart adjacent rearward reaches of the hand grip. This places the block 152 in an interposed in-line, series or drive line relationship with Bowden wire cable 24 and hand grip 22' in that the compressive or expansive thrust from operator manipulation of hand grip 22' is directly passed to the resiliently compressible block 152 and then directly from it to the Bowden wire cable 24.

The elastomeric block 152 is securely maintained between the two ribs by the termination of an upper rib structure 157 (FIG. 6) of upper ribs 158, 160 and 162 (FIG. 6) against which an upper face 164 of elastomeric block 152 abuts. The elastomeric block 152 is maintained in this position by a lower rib structure 166 (FIG. 7) which includes cross ribs 167, 168, 170 that extend slightly beyond axially extending ribs 172, 174 so as to transversely overlap axially extending ribs 176, 178 on upper housing part 46' and thereby maintain the lower rib structure 166 in abutting and overlapping contact with the ribs of the upper housing portion 46'. The axially extending ribs 172, 174 of lower rib structure 166 are inset relative to the axial ribs 176, 178 on the housing part 46' to more securely cap and maintain the elastomeric block 152 in the open box formed by the depending end ribs 154, 156 and the axially extending ribs 176, 178 all existent on the upper housing part 46'.

Figure 9:
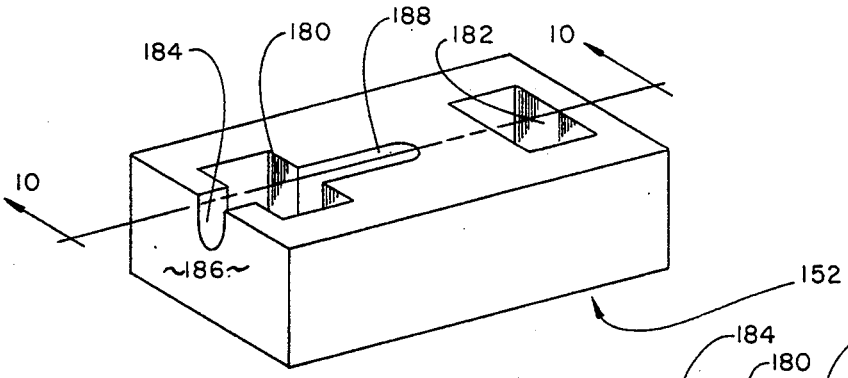
FIG. 9 is a perspective view of a resilient cushioning block which may be utilized with this hand grip.
Figure 10:
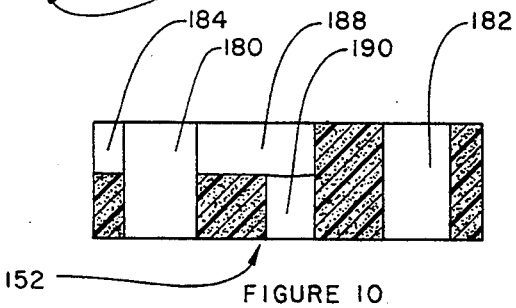
FIG. 10 is a cross-sectional elevational view of this cushioning block taken on line 10—10 of FIG. 9 and looking in the direction of the arrows.

Turning now specifically to FIGS. 9 and 10, it can be seen that elastomeric block 152 includes a pair of rectangular bores 180 and 182 therethrough which open to both sides of the block. These bores reduce the compressive section of the block making a high Durometer reading material having a higher durability usable. An elastomeric block utilizable in this invention could measure 1.2 inches long by 0.5 inches wide and 0.5 inches deep with a pair of rectangular bores each of sufficient size to make their side and outer end walls 0.075 inches wide. Such a block can be satisfactorily made from a urethane having Shore A reading of 45. Normally a block requiring a mechanical effort of between ½ lb. to 3 lb. to crush it sufficiently to initiate movement of the Bowden wire is sufficient but changing the wall thickness or material hardness can provide an optimum design for the characteristic of a give actuating linkage.

Elastomeric block 152 also includes a first semicircular groove 184 extending from a front 186 of it to the rectangular bore 180. Immediately behind this bore is a semicircular groove 188 that terminates in a downwardly disposed circular bore 190. It should be clear from the foregoing description that the hook 60' of the Bowden wire 24 safely and securely fits within the grooves 184 and 188 and elastomerically press fits in the circular bore 190 of the elastomeric block 152 to attach the Bowden wire 24 to it.

Figure 11:
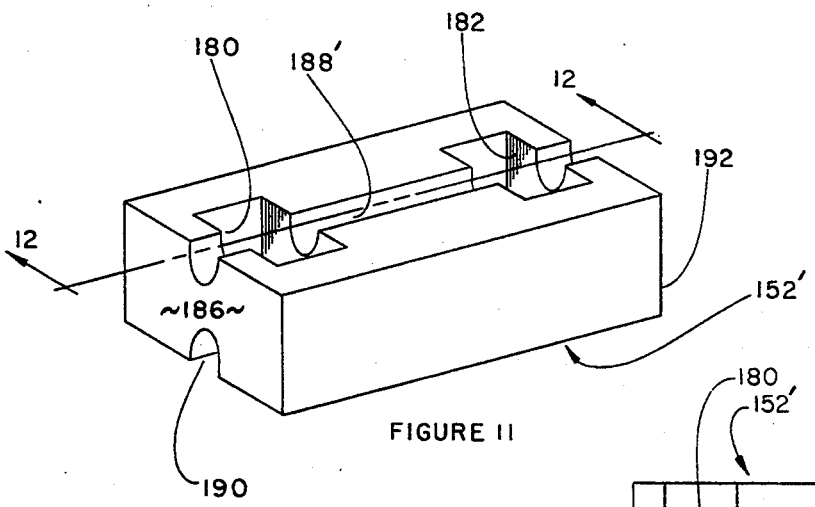
FIG. 11 is a perspective view of a second resilient cushioning block usable like the resilient cushioning block of FIG. 8.
Figure 12:
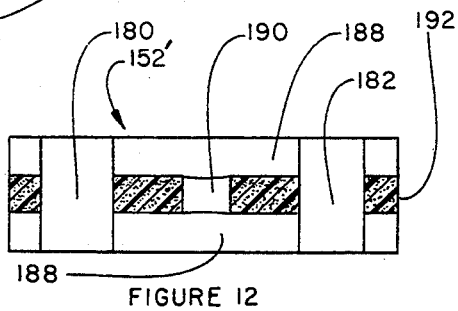
FIG. 12 is a cross-sectional elevational view of this block taken on line 12—12 of FIG. 11 and looking in the direction of the arrows.

FIGS. 11 and 12 disclose a second embodiment of the elastomeric block. Elastomeric block 152' still includes the rectangular cutout bores 180 and 182 but it also includes upper and lower (mirror image) semicircular through grooves 188', 188' that open to both the front face 186' and a rear face 192 of the elastomeric block 152'. The elastomeric block 152' may thereby be easily assembled in the hand grip 22' independent of its right side or upside down disposition as long as aligned properly within the box like ribs.

Figure 13:
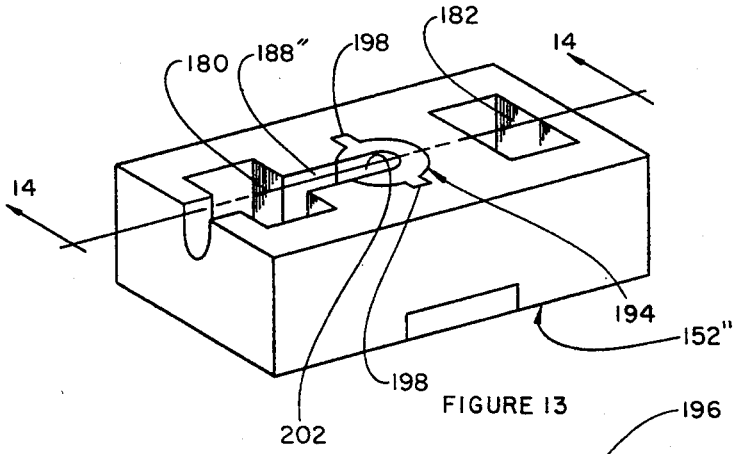
FIG. 13 is a perspective view of a third resilient cushioning block usable with the hand grip of FIGS. 5–7.
Figure 15:
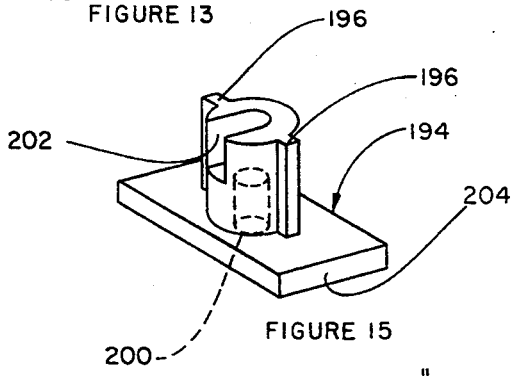
FIG. 15 is a perspective view of the insert piece which is inserted in the resilient cushioning block of FIG. 13.
Figure 14:
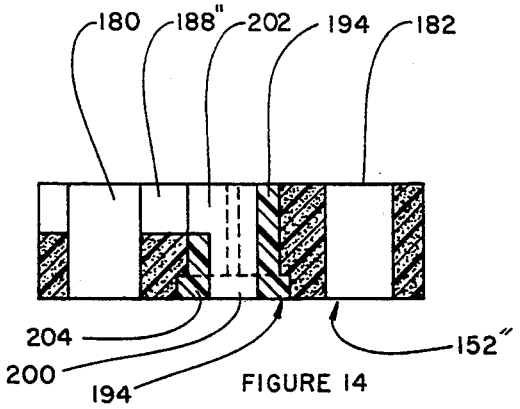
FIG. 14 is a cross-sectional elevational view of the resilient block of FIG. 13 taken on line 14—14 and looking in the direction of the arrows.
Figure 16:
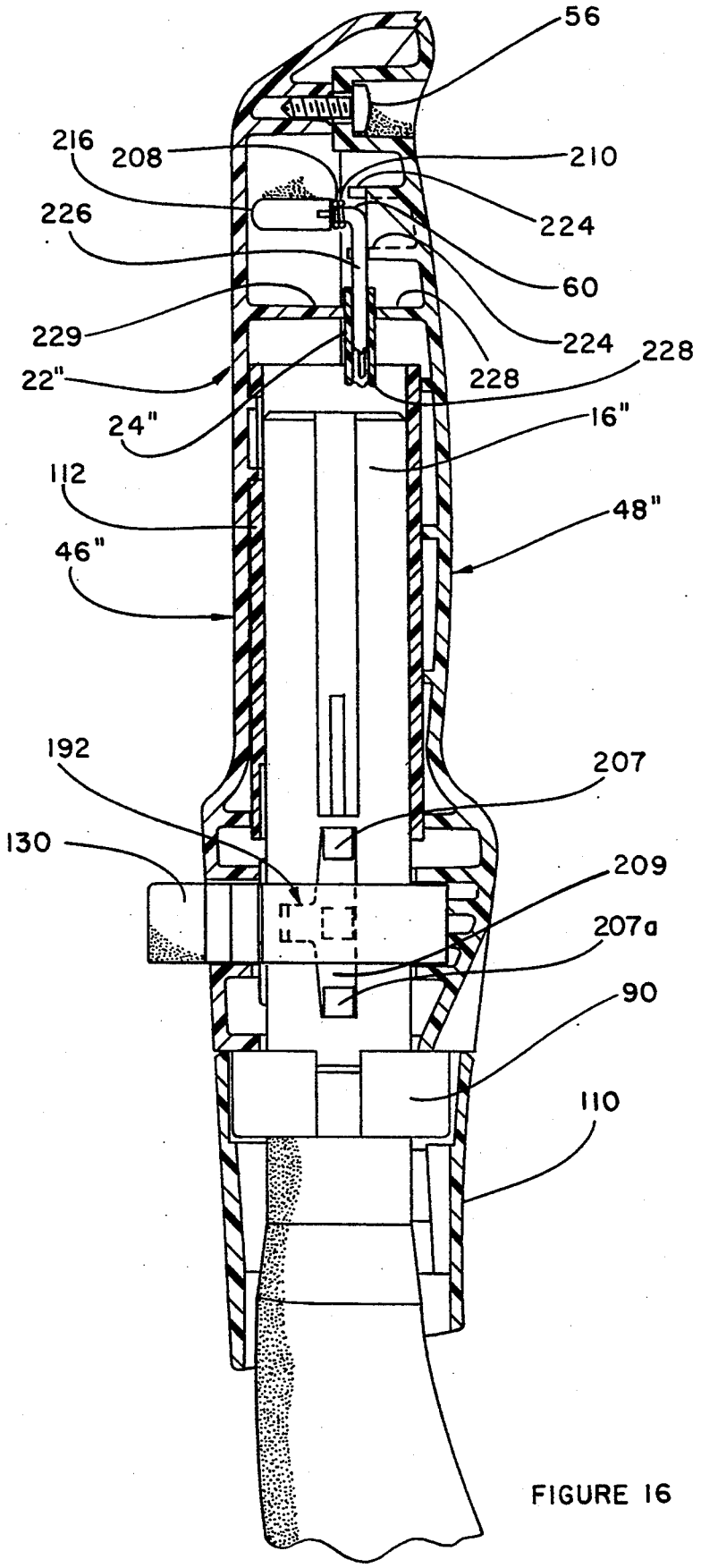
FIG. 16 is a cross-sectional elevational view of the preferred hand grip and cushioning spring arrangement.
Figure 18:
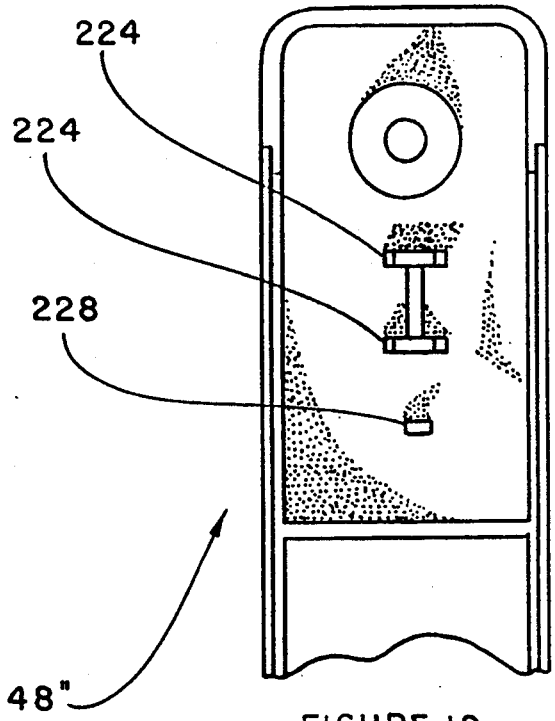
FIG. 18 is a partial plan view of the lower hand grip portion of FIG. 16.
Figure 17:
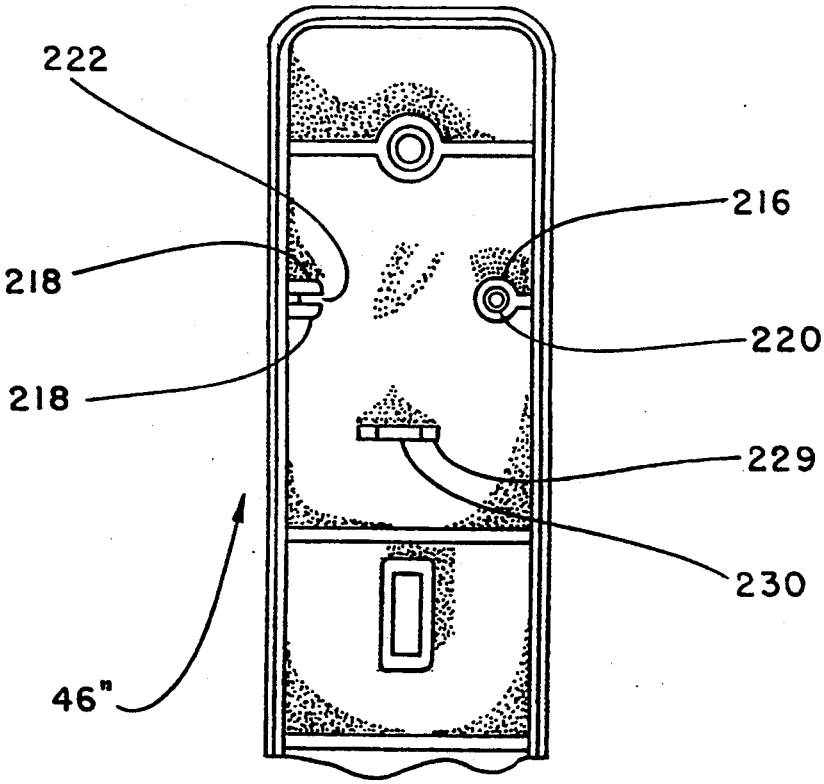
FIG. 17 is a partial plan view looking at the inside of the upper hand grip portion of FIG. 16.
Figure 19:
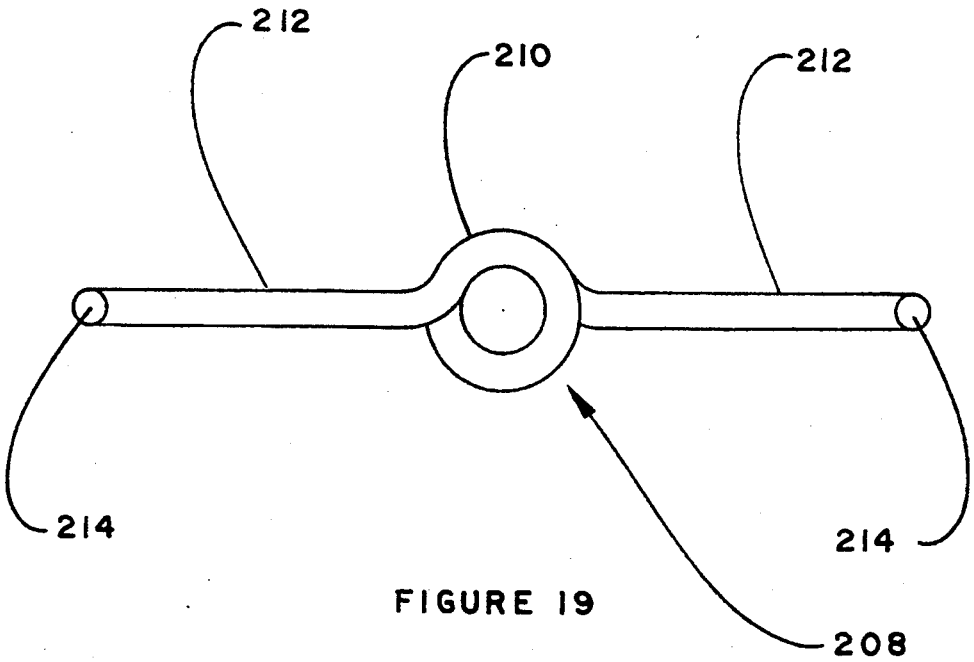
FIG. 19 is a plan view of the torsion spring utilized in the structure of FIG. 16.
Figure 20:
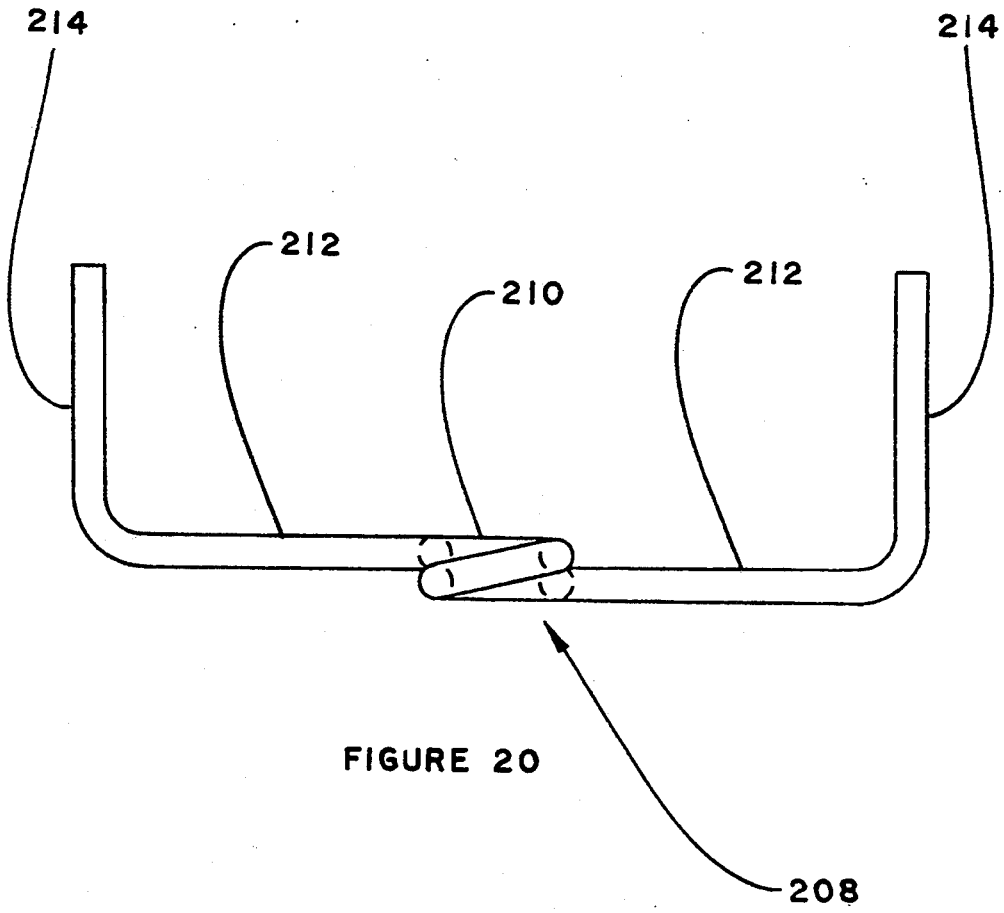
FIG. 20 is a side view of this same spring.

The elastomeric block 152" shown in FIGS. 13 and 14 is reinforced by a molded in harder plastic piece 194 (FIG. 15) that fits in an enlarged bore 190". The plastic piece 194 includes sidewardly extending rectangular wings 196, 196 which engage in similarly shaped recesses 198, 198 communicating with enlarged bore 190" so that the plastic piece is fitted nonturnably with the block 152". A second bore 200 in this piece lodges the hook 60' which also lies in a groove 188" and a groove 202 in the plastic piece 194. The plastic piece 194 also includes a rectangular base 204 which is inset when mounted with elastomeric block 152".

The elastomeric block 152" with insert just described finds its utility when the elastomeric block has a Shore A hardness of 35 or less, the insert serving as a reinforcement to prevent undue wear on the hook 60'.

The preferred embodiment of the invention is shown in FIGS. 16–20 and is used advantageously in a hand grip 22" that includes an upper housing part 46" and a lower housing part 48". These housing parts are held together at their front ends by the split compression ring 90 and at their rear ends by the screw 56. The usual wear or bearing sleeve 112 is included as well as a ring member 130 having, for example, a neutralling arrangement 206 and a button 132 (not shown) mating with an aperture (not shown), like the first embodiment, in a handle 16". This neutralling slot arrangement is rotary but similar to that shown in U.S. Pat. No. 4,845,803, owned by a common assignee and is not considered pertinent to the invention. The finger piece 134 aids in this turning movement. A pin 207 (207A in its lower position) of the neutralling arrangement 206 limits movement of the hand grip 44" relating to its handle through a handle slot 209. A handle shield 110 is also disposed at the front of the hand grip 22".

As is conventional, a Bowden wire cable 24" extends rearwardly through the hand grip 22" and includes hook 60" on its upper, outer distal end which is attached to a torsion spring 208, extending thereover, and having a pair of center coils 210 (FIGS. 19 and 20) and directly outwardly extending legs 212, 212. The spring legs 212, 212 also include upwardly turned, right angled ends 214, 214.

The ends 214, 214 of the torsion spring 208 are compressingly captured an integral boss 216 (FIG. 17) on upper handle grip housing 46' and between a pair of integral ribs 218, 218 on this same housing. It should be clear, then, that one of the spring ends 214 is forced upwardly into a small bore 220 in boss 216 of housing portion 46" while the other spring end 214 is forcedly received upwardly in a gap 222 between the integral ribs 218, 218 of housing portion 46" with spring center coils 210 of torsion spring 208 is fixed over hook 60". Movement of the Bowden wire cable 24" backwardly and forwardly, as driven by the hand grip 22", is interposed thereby cushioned and this cushioning is between the hand grip and cable. This places these three elements in an in-line, series or drive line relationship.

Rectilinear guidance for the Bowden wire 24" is also afforded in the rearward end of the hand grip 22" to aide in the smoothness of this resilient cushioning. The lower hand grip portion 48" (FIG. 18) includes a pair of upwardly opening U-shaped stirrups 224, 224. These two stirrups each partially encompass a wire 226 of the extending Bowden wire cable 24" to effectively guide it. A rib 228 on the lower handle portion 48" downwardly depending and a stirrup 229 on the upper handle portion 46" are also provided to support an adjacent sheath portion 230 of the Bowden wire cable 24".

It should be clear from the foregoing that the objects of the invention have been fully satisfied by the structure described. It also should be apparent that many obvious modifications could be made to the invention. For example, the resilient means, whatever its configuration, could be mounted in a different location in the actuating linkage that initiates clutching action and such mounting, if still in series, would provide some resilient cushioning to the linkage and thereby eliminate some of the jumpiness and jerkiness of previous actuating linkage arrangements. Further, a differing spring such a compression or tension spring could also be utilized fairly easily and obviously in view of the inventive description offered.

What is claimed is:

1. A rigid actuating linkage arrangement in a power driven cleaner including:

a) a nozzle on said cleaner;

b) a handle attached to said nozzle and extending in an axial direction;

c) a power drive unit disposed in said nozzle;

d) said rigid actuating linkage extending downwardly at least partly within said handle to said power drive unit and reciprocally mounted within said handle for actuating said power drive unit;

e) a hand grip reciprocally mounted on said handle and driving said rigid actuating linkage within said handle in a reciprocal manner axially towards and away from said power unit to form a drive line with said actuating linkage to thereby activate and deactivate said power unit;

f) a means for resiliently acting against said hand grip reciprocating movement, disposed in said actuating linkage arrangement; and g) said resilient means also being interposed in an in-line series relationship in said drive line formed by said hand grip and said actuating linkage and mounted between them.

2. The actuating linkage arrangement in a power drive cleaner as set out in claim 1 wherein:

a) said resilient means comprises a non tubular compression block.

3. The actuating linkage arrangement in a power drive cleaner as set out in claim 1 wherein:

a) said resilient means comprises a torsion spring.

4. An actuating linkage arrangement for a power drive cleaner including:

a) a rigid actuating linkage disposed within a handle for said power drive cleaner;

b) a hand grip mounted on said handle and moveable relative thereto in an inward and outward direction;

c) said hand grip driving said rigid actuating linkage reciprocally within said handle also in said inward and outward direction; and d) a means for resiliently cushioning said rigid actuating linkage arrangement interposed functionally and structurally between said hand grip and said rigid actuating linkage in a series in-line relationship whereby operation of said actuating linkage arrangement is smooth and with limited jerkiness.

5. An actuating linkage arrangement for a power drive cleaner as set forth in claim 4 wherein:

a) said resilient means is wholly lodged by said hand grip,

6. The actuating linkage arrangement for a power drive cleaner as set out in claim 5 wherein:

a) said resilient means takes the form of a compression block,

7. The actuating linkage arrangement for a power drive cleaner as set out in claim 5 wherein:

a) said resilient means comprises a torsion spring,

8. The actuating linkage arrangement for a power drive cleaner as set out in claim 6 wherein:

a) said compression block is fixed in a housing integrally formed in said hand grip by being abuttingly maintained between two extending walls in said housing; and b) said actuating linkage is directly attached to said compression block.

9. The actuating linkage arrangement for a power drive cleaner as set out in claim 8 wherein:

a) said compression block includes at least one discontinuity extending completely through said compression block to reduce its overall wall thickness and thereby its resistance to deformation.

10. The actuating linkage arrangement for a power drive cleaner as set out in claim 9 wherein:

a) an insert of denser material than the material density of said compression block is inserted therein to provide for connection to said actuating linkage.

11. The actuating linkage arrangement for a power drive cleaner as set out in claim 7 wherein:

a) said torsion spring extends transversely across said hand grip with its ends fixed in said hand grip.

12. The actuating linkage arrangement for a power drive cleaner as set out in claim 11 wherein:

a) said torsion spring includes at least one center coil; and b) said center coil serves as a connection to which said actuating linkage is directly connected.

13. The actuating linkage arrangement for a power drive cleaner as set out in claim 12 wherein:

a) said actuating linkage includes a hook at its hand grip end; and b) said hook engages in said center coil to connect said actuating linkage resiliently drivingly with said hand grip.

14. The actuating linkage arrangement for a power drive cleaner as set out in claim 13 wherein:

a) said hand grip includes means for aligned guided action of said actuating linkage and said torsion spring.

15. An actuating linkage arrangement usable with a power assisted appliance having an axially extending handle including:

a) a hand grip reciprocally mounted on said handle;

b) a rigid actuating linkage extending down said handle and within said handle and reciprocatorily driven by said hand grip within said handle;

c) a means providing a resilient cushioning effect, disposed in an interposed and an in-line series abutting relationship with said hand grip and said rigid actuating linkage d) a power drive unit for said power assisted appliance;

e) said means providing a resilient cushioning effect being situated remote from said power drive unit and adjacent said handle; and f) said rigid actuating linkage moving, during said reciprocatory driving by said hand grip axially towards and away from said power drive unit within said handle for actuation of said power assisted appliance.

* * * * *